US007530860B2

(12) United States Patent
Chen et al.

(10) Patent No.: US 7,530,860 B2
(45) Date of Patent: May 12, 2009

(54) CONTACT TERMINAL FOR ELECTRICAL CONNECTOR

(75) Inventors: De-Jin Chen, ShenZhen (CN); Yu-San Hsiao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/986,800

(22) Filed: Nov. 26, 2007

(65) Prior Publication Data

US 2008/0124949 A1 May 29, 2008

(51) Int. Cl.
*H01R 11/22* (2006.01)

(52) U.S. Cl. ..... 439/852

(58) Field of Classification Search ..... 439/851, 439/852, 856, 859

See application file for complete search history.

(56) References Cited

U.S. PATENT DOCUMENTS 3,663,931 A * 5/1972 Brown ..... 439/75
3,853,389 A * 12/1974 Occhipinti ..... 439/747
4,721,484 A * 1/1988 Sakamoto et al. ..... 439/842
5,997,363 A * 12/1999 Joly ..... 439/748

* cited by examiner

*Primary Examiner*—Truc T Nguyen
*Assistant Examiner*—Xuong M Chung-Trans
(74) *Attorney, Agent, or Firm*—Wei Te Chung

(57) ABSTRACT

A contact terminal for an electrical connector includes a mating section (21) defining a receiving cavity adapted for receiving a mating component. The mating section includes opposed side walls having thereon protrusions (210) extending into the receiving cavity. The protrusions define thereof mating surfaces adapted to engage the mating component. This configuration of employing surface engagement has the advantage of attaining reliable mechanical and electrical connection between the mated connector and component over the prior art of employing point engagement.

13 Claims, 2 Drawing Sheets

CONTACT TERMINAL FOR ELECTRICAL CONNECTOR

BACKGROUND OF THE INVENTION

1. Field of the Invention

The present invention relates to the art of electrical connectors, and more particularly to a contact terminal for an electrical connector.

2. Description of the Related Art

A conventional contact terminal for an electrical connector typically include a base section for being secured in a connector body, a mounting section extending from the base section and adapted to be mounted onto a printed circuit board, and a mating section extending from the base section for mating with a mating contact from a plug connector. The mating section defines a receiving cavity, which is formed by a peripheral wall with an axial gap thereon. The peripheral wall includes opposed side walls, which are adapted for resiliently engaging the mating contact of the plug connector. This arrangement may result in an unreliable contact between the contact terminal and the mating contact of the plug connector, which may cause mechanical and electrical connection failure of the mated connectors. Therefore, there is a need to provide a contact terminal to resolve the above-mentioned problem.

SUMMARY OF THE INVENTION

A major object of an embodiment of the present invention is to provide a contact terminal for having reliable mechanical and electrical connection with a mating component.

A contact terminal for an electrical connector according to an embodiment of the present invention includes a base section for being secured in a connector body, a mounting section extending from the base section and adapted to be mounted onto a printed circuit board, and a mating section extending from the base section. The mating section defines a receiving cavity adapted for receiving a mating component. The mating section includes opposed side walls having thereon protrusions extending into the receiving cavity. The protrusions define thereof mating surfaces adapted to engage the mating component. Thus, this configuration of employing a surface engagement has the advantage of attaining reliable mechanical and electrical connection between the mated connector and component, in that such a surface engagement may enlarge the engagement area between the mated connector and component.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
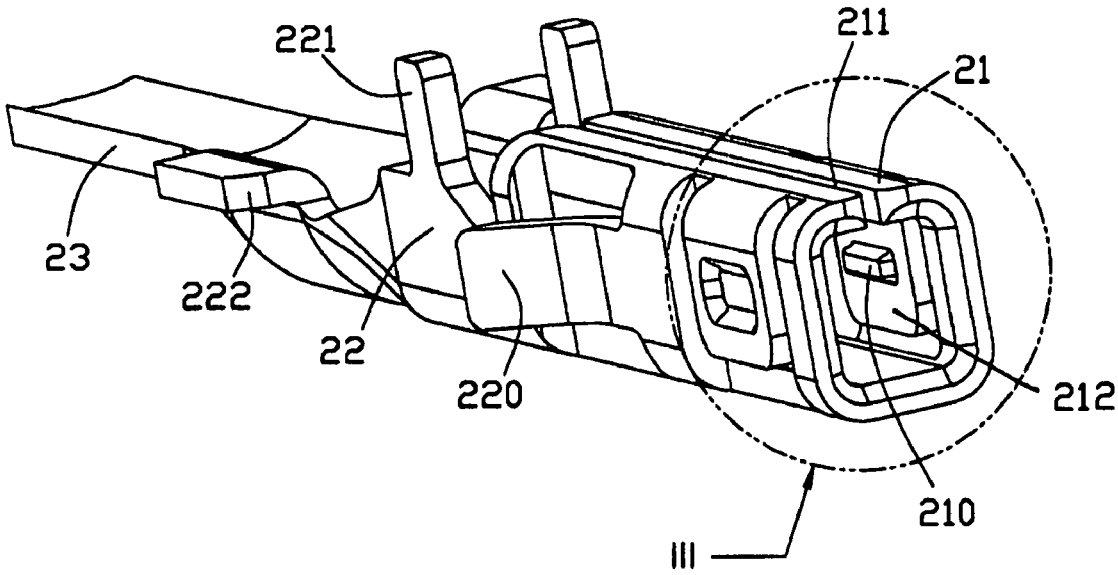
FIG. 1 is a perspective view of a contact terminal for an electrical connector according to an embodiment of the present invention.
Figure 2:
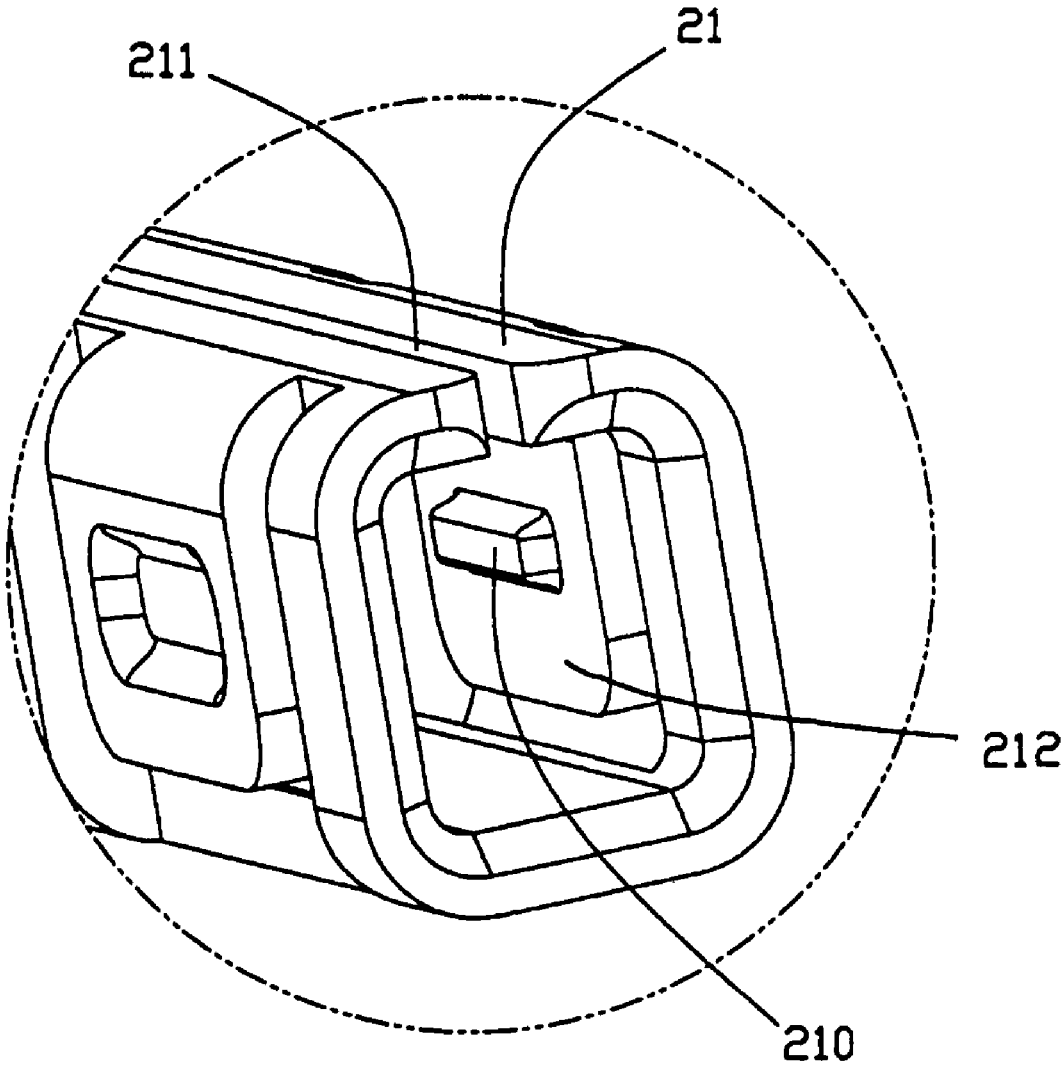
FIG. 2 is an enlarged, perspective view of part III of the contact terminal of FIG. 1.

Referring to FIGS. 1 and 2, a contact terminal of an electrical connector is shown according to an embodiment of the present invention. The contact terminal includes a middle base section 22 for being secured in a passageway of a connector body (not shown), a mating section 21 extending forwardly from the middle base section 22 and adapted to mate with a mating component (not shown), and a mounting section 23 extending rearwardly from the middle base section and adapted to be mounted onto a printed circuit board (not shown). In this embodiment, the passageway for receiving the contact terminal is of a rectangular shape.

The mounting section 23 is of a plate, which extends along a length axis of the passageway. The middle base section 22 includes a pair of first segments 222 extending transversely and outwardly from a front end of the mounting section 23, a pair of second segments 221 attached to the first segments 222 and extending longitudinally and upwardly from the base section 22, and a pair of third segments 220 attached to the second segments 221 and extending rearwardly and outwardly from the base section 22. The third segments 220 are also attached to a rear end of the mating section 21, and configured for preventing the contact terminal from being removed from the passageway of the connector body when the contact terminal is received within the passageway. The second segments 221 are configured for holding the contact terminal in position within the passageway. The first segments 222 are configured for preventing rotary movement of the contact terminal with respect to the length axis of the passageway when the contact terminal is received within the passageway.

The mating section 21 defines a receiving cavity extending axially of the passageway of the connector body. The receiving cavity is defined by a peripheral wall with an axial gap 211 thereon. Thus, such a receiving cavity is adapted to resiliently receive the mating component due to the existence of the axial gap 211. In this embodiment, the mating component (not shown) includes a mating portion, to be received within the receiving cavity of the mating section 21, being generally of a rectangular shape. The peripheral wall, employed to form the receiving cavity, is then configured to surround the rectangular mating portion of the component. The peripheral wall defines opposed side walls with thereof a pair of downwardly cantilevered spring arms 212 each having thereon a protrusion 210 extending into the receiving cavity. The protrusions 210 have thereof mating surfaces adapted to engage the mating component. In this embodiment, the mating surface is of a rectangular shape, which extends axially of the receiving cavity. Thus, the terminals of the mated connector and component employ surface engagement therebetween, which has the advantage of attaining reliable mechanical and electrical connection between the mated connector and component in that such a surface engagement may enlarge the engagement area between the mated connector and component. It is noted that the spring arm 212 extends coplanar/compliant with the top wall and the side walls and only the corresponding protrusion 210 extends into the receiving cavity to engage the mating component. In this embodiment, the protrusions 210 are formed by punching the respective side walls. In an alternative embodiment, the protrusions may be formed by attaching to the respective side walls.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. A contact terminal for an electrical connector, comprising:

a base section for being secured in a connector body;

a mounting section extending from said base section, said mounting section adapted to be mounted onto a printed circuit board;

a mating section extending from said base section, said mating section defining a receiving cavity, which extends along a front-to-back insertion direction and is adapted for receiving a mating component; and wherein said mating section including opposed side cantilevered spring arms, each of which is elastically floatable around a top wall side edge parallel to said insertion direction, the cantilevered spring arms having thereon protrusions extending into said receiving cavity, said protrusions defining thereof mating surfaces adapted to engage the mating component.

2. The contact terminal of claim 1, wherein said receiving cavity is defined by a peripheral wall with an axial gap thereon.

3. The contact terminal of claim 1, wherein said mating component has a mating portion being of a rectangular shape.

4. The contact terminal of claim 1, wherein said protrusions are formed by punching the respective side walls.

5. The contact terminal of claim 1, wherein each of said mating surfaces extends axially of said receiving cavity.

6. The contact terminal of claim 5, wherein each said mating surface is of a rectangular shape.

7. A contact terminal for an electrical connector, comprising:

a base section equipped with retention means for fastening to an insulative housing of said connector;

a mating section essentially including opposite top and bottom walls and two opposite side walls commonly defining a frame like cross-section with a receiving cavity therein; and a pair of opposite cantilevered spring arms formed and stamped from the mating section with a pair of punched protrusions thereon, respectively; wherein the punched protrusions extend into the receiving cavity while the spring arms being coplanar with the opposite side walls of said mating section, respectively.

8. The contact terminal as claimed in claim 7, wherein said spring arms extend from the top wall where a gap is formed so as to enhance flexibility of the spring arms.

9. The contact terminal as claimed in claim 8, wherein each of said spring arms extends downward from the top wall toward the bottom wall and is a part of the corresponding side wall.

10. The contact terminal as claimed in claim 9, wherein said spring arms are located adjacent to a front opening of said receiving cavity.

11. The contact terminal as claimed in claim 8, wherein said gap extends along a front-to-back direction of the mating section.

12. A contact terminal for an electrical connector, comprising:

a base section equipped with retention means for fastening to an insulative housing of said connector;

a mating section essentially including opposite top and bottom walls and two opposite side walls commonly defining a frame like cross-section with a receiving cavity therein, said top wall defining a gap extending along a front-to-back direction so as to have the top wall and the neighboring side walls own resiliency thereof; and a pair of opposite cantilevered spring arms formed and stamped and unitarily and initially extending from the top wall downwardly toward in a vertical direction perpendicular to said front-to-back direction and terminated at the bottom wall; wherein each of said spring arms forms thereon a protrusion extending into the receiving cavity.

13. The contact terminal as claimed in claim 12, wherein said spring arms are located adjacent to a front opening of said receiving cavity.

* * * * *